United States Patent [19]

Lenker et al.

[11] 4,205,602

[45] Jun. 3, 1980

[54] APPARATUS FOR TYING CAULIFLOWER

[75] Inventors: Don H. Lenker; Dennis F. Nascimento, both of Salinas, Calif.

[73] Assignee: The United States of America as represented by the Secretary of Agriculture, Washington, D.C.

[21] Appl. No.: 970,941

[22] Filed: Dec. 19, 1978

[51] Int. Cl.[2] ..... B65B 13/26

[52] U.S. Cl. ..... 100/4; 100/21; 47/1 R

[58] Field of Search ..... 100/4, 8, 21; 47/1

[56] References Cited

U.S. PATENT DOCUMENTS

| | | | |
|---|---|---|---|
| 1,407,481 | 2/1922 | Radechovsky | 100/21 |
| 2,346,786 | 4/1944 | Radeck | 100/4 |
| 3,015,187 | 1/1962 | Grether | 47/1 |
| 3,771,257 | 11/1973 | Smith | 47/1 |

*Primary Examiner*—Billy J. Wilhite

*Attorney, Agent, or Firm*—M. Howard Silverstein; David G. McConnell; Theodore J. Leitereg

[57] ABSTRACT

An apparatus for tying loosely-defined soft packages is described. A means for gathering or firming the loosely-defined package is fixed to a frame to which is also fixed a means for holding the gathered packages. A tying means, mounted on the frame, is actuated by a sensing means designed such that the tying means is actuated at the same relative position for each package tied.

6 Claims, 11 Drawing Figures

APPARATUS FOR TYING CAULIFLOWER

BACKGROUND OF THE INVENTION

1. Field of the Invention

This invention relates to and has among its objects the provision of novel apparatus and methods for tying loosely defined, soft packages, e.g., the leaves of vegetable heads such as cauliflower. Further objects of the invention will be evident from the following description wherein parts and percentages are by weight unless otherwise specified.

2. Description of the Prior Art

The head of the cauliflower plant, generally the part eaten by man, must be shaded from the sun during its growth. Sunlight causes the cauliflower head to develop a brown color and a strong flavor, both characteristics being undesirable to the consumer. A substantial portion of head growth occurs after the remainder of the plant has attained most of its growth. For the most part, head growth takes place about one or two weeks before harvest.

To prevent sunlight damage to the cauliflower fruit, the leaves of the plant are gathered by hand and secured over the vegetable head. This procedure is time-consuming and costly. To avoid this expense many growers disregard the above procedure entirely and chance the consequences. Other growers tie only one or two leaves over the vegetable head in an attempt to compromise the high cost of the aforementioned protective procedures.

Tying machines are known and described in U.S. Pat. Nos. 1,407,481, 2,346,786, 3,015,187, and 3,771,257. The known tiers, however, cannot be employed to tie soft packages such as vegetable leaves and the like.

SUMMARY OF THE INVENTION

We have discovered a method and apparatus which avoid the above problems. The apparatus of the invention allows mechanical tying of loosely defined, soft packages such as the leaves of cauliflower plants.

In the apparatus of the invention a means for gathering or firming the loosely defined, soft packages is fixed to a frame to which is also fixed a means for holding the gathered packages. Also mounted on the frame is a means for tying the gathered packages actuated by a sensing means designed to activate the tying means at the same relative position for each package tied.

The tying means includes a pair of parallel linkages mounted on a frame on which is also rotatably mounted a needle for conveying string around the gathered package. A cam-operated flipper is mounted on the frame and communicates with the actuating means to position the string against an anvil also mounted on the frame. Means for knotting the so-positioned string and means for removing the knot from the knotting means are also included on the frame.

The means for actuating the tying means includes a spring-loaded, horizontally-positioned roller. The roller travels along the gathered package below the holding means and activates the tying means at a point whereat the roller just passes the center of the gathered package.

The primary advantage of the invention is a substantial reduction in the time and expense of tying the cauliflower plants. Less than one percent of the plants are not tied by the instant apparatus. Furthermore, the plants are secured individually. This is an important feature of the present invention because cauliflower is harvested selectively and the tied plants must be easily separable from each other so that mature heads may be taken and immature heads left behind and so that individual heads may be picked up by a mechanical harvester.

Another advantage of the invention is that it permits tying of loosely defined, soft packages. Heretofore, commercial tiers have been unable to achieve this result and were successful only in tying well-defined, firm packages. In our invention the twine is positioned and held so that a proper knot can be tied and then removed from the mechanism; consequently, both firm and soft packages may be tied by the apparatus of the invention.

The sensing means employed in our apparatus affords the advantage of tying only individual packages. The tier is actuated just after the largest diameter (or center) of the package is encountered by the sensing roller. Thus, activation occurs at the same position relative to the package regardless of the package size. Furthermore, the sensing means causes correct actuation of the tying means even if the package is out of line or the tier is off the center of the row of packages. This feature is particularly important in tying plants such as cauliflower and cabbage, which have much longer stems than, for example, lettuce plants and grow further out of line from the row in which they are planted than do lettuce plants. That is to say many of the cauliflower heads are non-colinear with the stalk line in a particular row. Generally, the stalks of the plant remain in a straight line corresponding to that formed when the seeds are planted. The plants, themselves, however, grow out of this stalk line, i.e., they are non-colinear therewith. Lettuce heads, on the other hand, will grow colinearly within the row.

DESCRIPTION OF THE PREFERRED EMBODIMENTS

Figure 1:
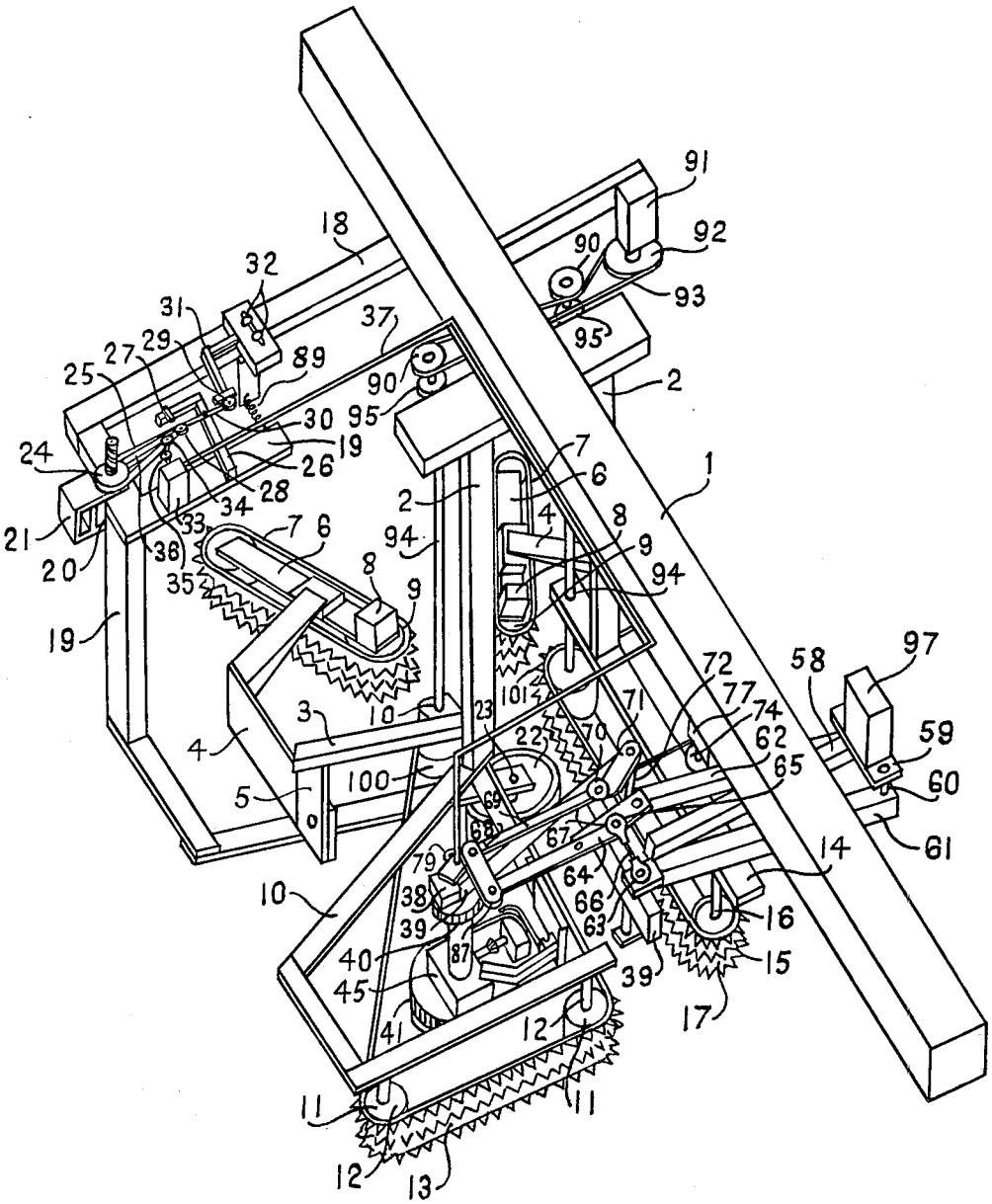
FIG. 1 is a perspective view of the tying apparatus of the invention taken at an angle from the top-rear.
Figure 4:
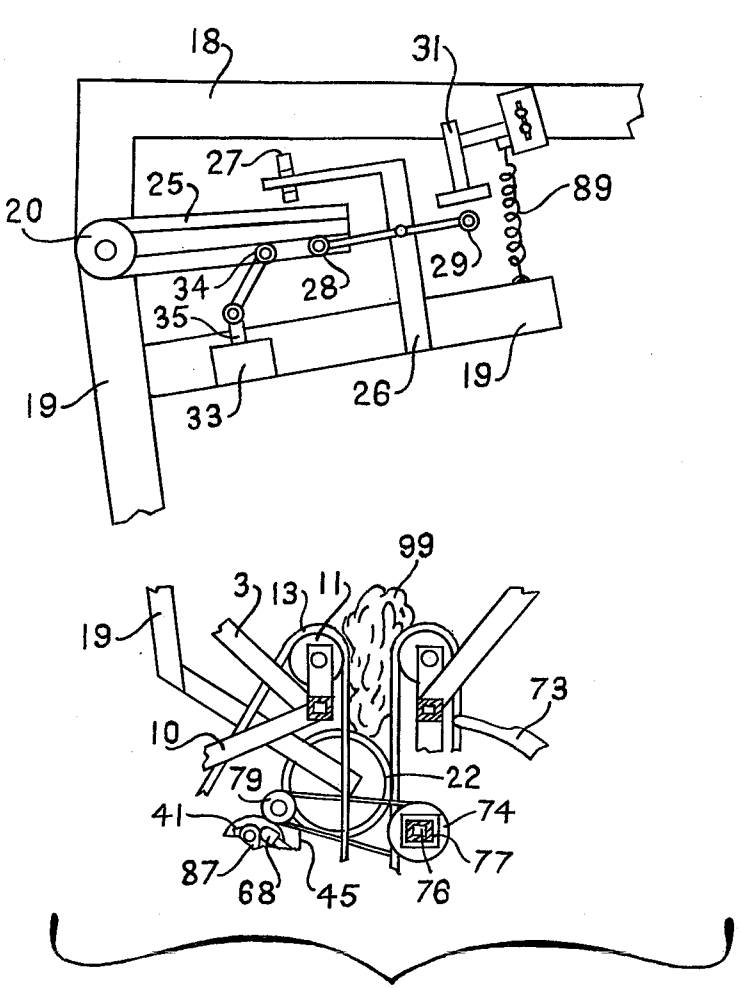
FIGS. 4–8 are top plan views of the sensing mechanism of the instant apparatus as it senses a vegetable head. A portion of the sensing means is depicted at a larger scale than the remainder.
Figure 2:
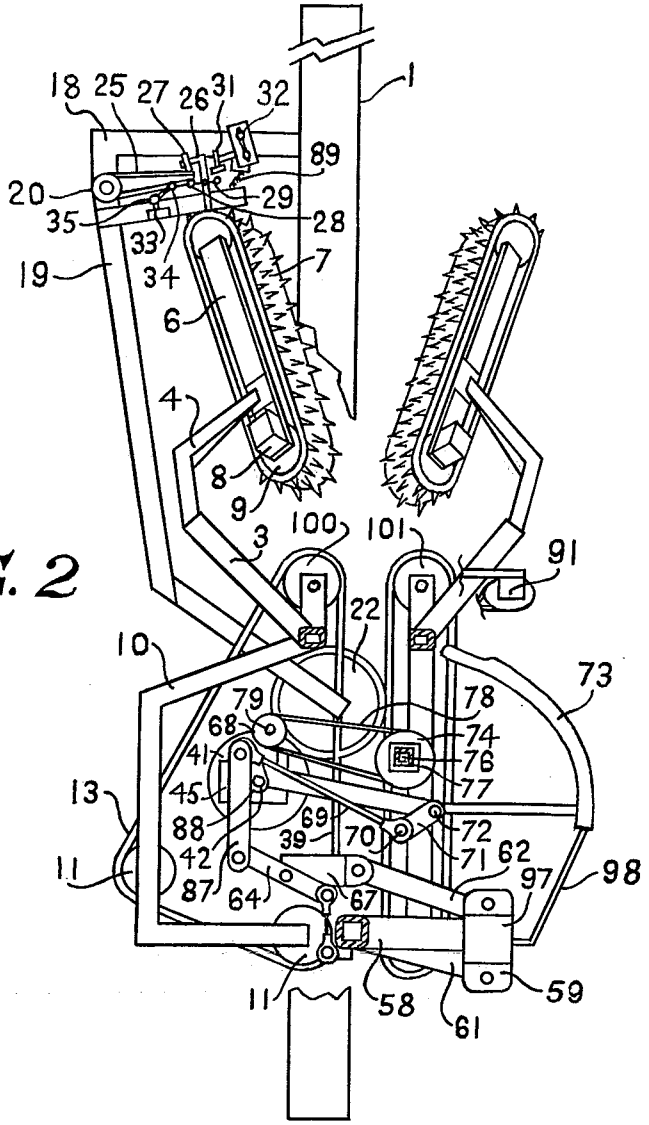
FIG. 2 is a top plan view of the same apparatus.
Figure 3:
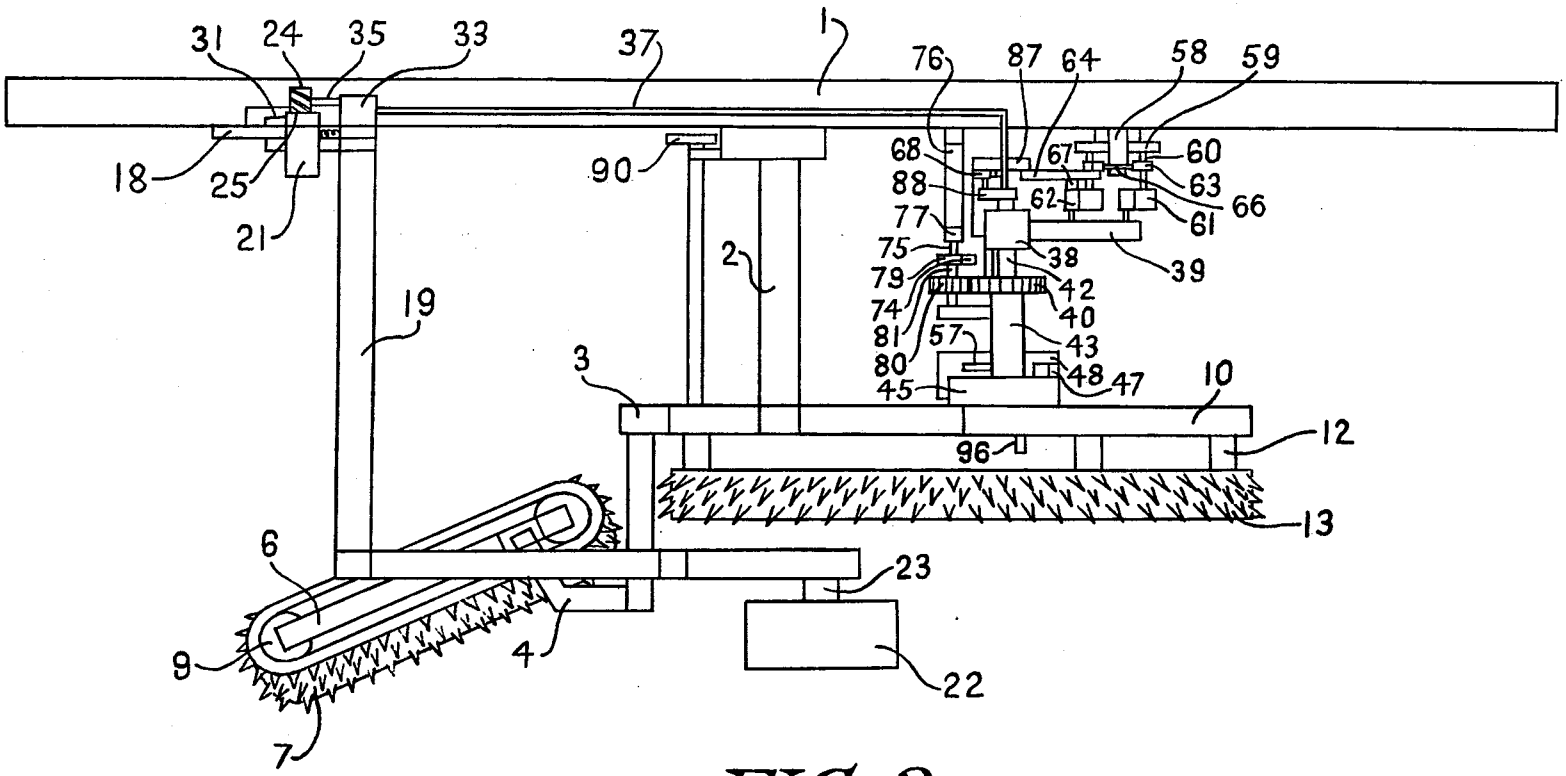
FIG. 3 is a side view of the apparatus of the invention.

Referring to FIGS. 1-3, fixedly attached to subframes 2, which in turn are fixed to frame 1, are sideward-projecting arms 3 pivotally connected to arms 4 by means of downwardprojecting members 5. Arms 4 are secured to support members 6 of the gathering means of the instant apparatus, which comprises two endless belts 7 rotatably mounted on 6. The front ends of belts 7 are sloped downward at an angle of about 45° from the center of the apparatus. Furthermore, belts 7 are inclined at an angle of about 30° or less from the vertical. The belts are driven by means 8, which may take the form of a hydraulic motor or the like and which drives rollers 9.

Also mounted on subframe 2 is support member 10 on which rollers 11 are rotatably mounted by means of shafts 12. Shafts 94 are attached at one end to rollers 100 and 101 and at the other end to sprockets 90 and are journalled in support members 10 and 14, respectively. Belt 13 surrounds rollers 11 and 100 thus forming one-half of the holding means for the gathered leaves. Support member 14 is attached to subframe 2 and roller 15 is rotatably mounted thereon by means of shaft 16. Surrounding 15 and 101 is belt 17 which together with belt 13 form the above-mentioned holding means. The belts employed in the gathering and holding means of the invention are made from compressible, flexible material, such as rubber belts with finger-like projections that will grip the loosely-defined packages. Motor 91 is secured to frame 1 and communicates with 90 by means of sprocket 92, rotatably mounted on 91, and belt 93. The upper portion of shafts 94 are journalled in supports 95 fixed to subframe 2.

Subframe 18 is fixedly attached to 1 and arm 19 is pivotally connected at one end to 18 through bearing housing 20 mounted between the arms of yoke 21. Rotatably mounted at the other end of 19 is roller 22 by means of bearing housing 23. Generally, roller 22 is about 10–30 cm in diameter preferably with an outer perimeter of pliable material such as neoprene foam or the like about 1–5 cm thick. The movement of arm 19 is restricted by tension spring 89, attached at one end to 18 and at the other to 19. Compression spring 24 pushes brake 25, which also pivots on housing 20, against yoke 21. Arm 26 is fixedly attached to 19 and set screw 27 is mounted therein. Rollers 28 and 29 are rotatably mounted on support arm 30 which in turn is pivotally mounted on 26. Stop 31 is mounted on 18 and bolts 32 allow the position of 31 to be altered with respect to roller 29. Alternately, stop 31 could be mounted on bearing housing 20.

Actuator 33 is mounted on 19 with actuator wheel 34 connected thereto by means of actuator arm 35. Rollers 29 and 34 cooperate with brake 25 along ridge 36.

Figure 9:
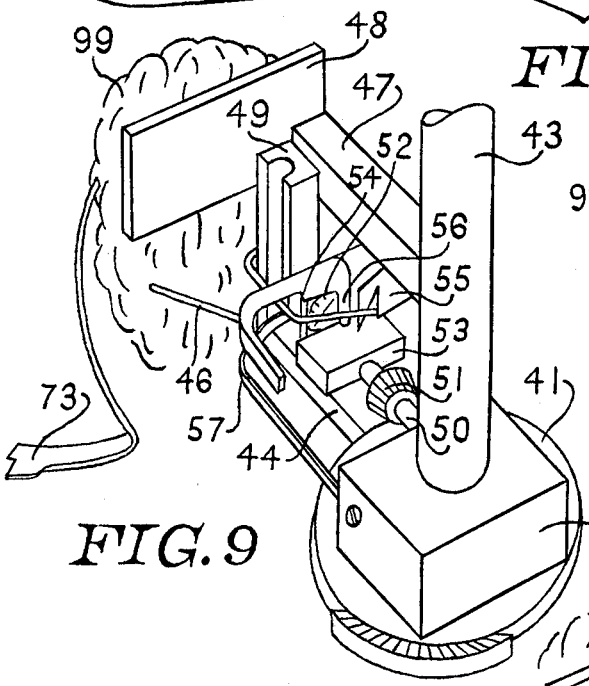
FIGS. 9–11 are perspective views of the tying mechanism of the invention taken at an angle from the side.

Actuator 33 is electronically linked by means of wire 37 to clutch assembly 38, which is fixedly secured to frame member 39 of the tying means. Gear 40 is rotatably engageable with shaft 42, which projects down and through bearing housing 43 and is fixedly attached to cam gear 41. Referring to FIG. 9, rotatable shaft 44 communicates with cam gear 41 and has at its terminus flipper 46. Support member 47 is fixed to housing 45 at one end and to plate 48 at its other end. Anvil 49 is also secured to member 47 as well as to plate 48 and is indented on one face to accommodate flipper 46. Shaft 50 is rotatably mounted in housing 45 with gear 51 fixed thereto and communicating with cam gear 41 to drive standard knotter 52 by means of shaft 50, which is also rotatably mounted in housing 53. Knotter 52 includes bills 54, string-holder 55, and knife 56. Stripper 57 is pivotally attached to 45 and actuated by cam gear 41. Switch 96 is mounted on plate 48.

Referring again to FIGS. 1–3 support 58 is fixed to frame 1. At one end of 58 plate 59 is fixedly attached and bearing housings 60 project downwardly therefrom and are journalled in linkage arms 61 and 62. The opposite ends of linkage arms 61 and 62 are journalled in tying means frame 39. The dimensions of parts 59, 61, 62, and 39 must be such as to maintain linkage arms 61 and 62 in a parallel configuration. Tie rod 63 is fixed to the other end of 58.

Linkage arm 64 is pivotally connected to tie rod end 65, which is linked to 63 through rod 66. Arm 67 is pivotally attached to 64 and fixed to frame 39. Arm 64 is pivotally connected to arm 87, which in turn is pivotally attached to the end of crank 88.

Tie rod end 68 is also pivotally attached to crank 88 which in turn is fixedly connected to 42. Tie rod 69 links 68 to tie rod end 70, pivotally anchored to arm 71. Downward-projecting shaft 72 is fixed at one end to 71 and at the other to needle 73. The dimensions of 69–73 should allow needle 73 to cooperate with string holder 55.

Large pulley 74 is mounted on shaft 75 of hydraulic motor 76 fixed to frame 1. Gear 40 is driven at a speed of about 50–70 rpm when the machine is operated at a ground speed of 0.5 mph. In general, the speed of gear 40 is dependent on the ground speed of the apparatus and the distance the tying means moves during one tying operation, both of which determine the number of ties made per minute. Belt 78 links pulley 74 with small pulley 79, which is connected to gear 80 through bearing housing 81.

String reservoir 97 containing string 98 is mounted on plate 59. The string communicates with needle 73 and string holder 55.

The operation of the apparatus of the invention is next described in detail with reference to the attached drawings. Cauliflower leaves (99) are encountered first by belts 7 of the gathering means of the instant device driven by hydraulic motors 9 at a speed slightly faster than ground speed, i.e., about 1–2 times ground speed. The leaves are both gathered and passed toward belts 13 and 17 of the holding means by belts 7. The speed of belts 13 and 17 is generally about ground speed.

Figure 5:
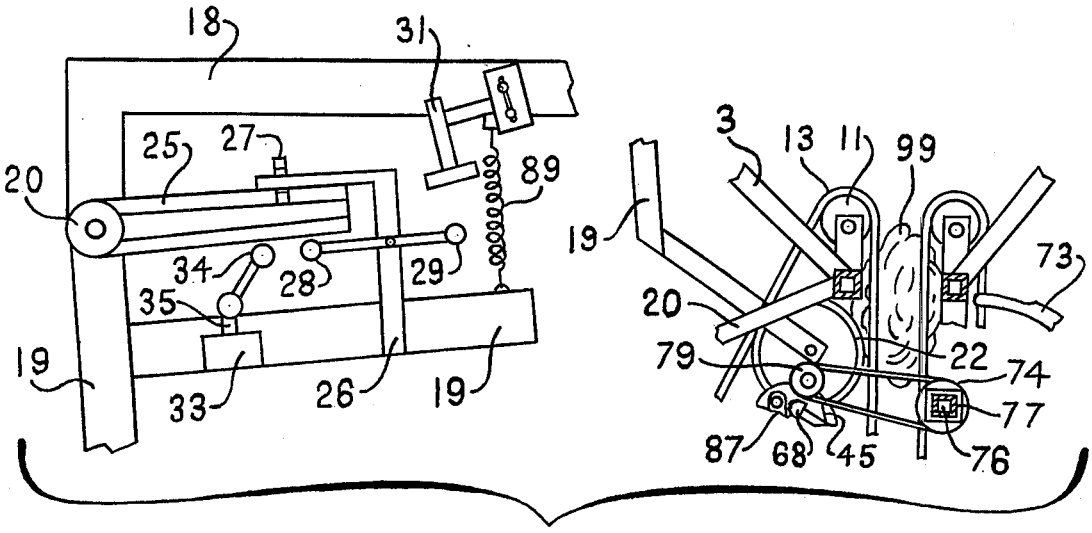
Figure 6:
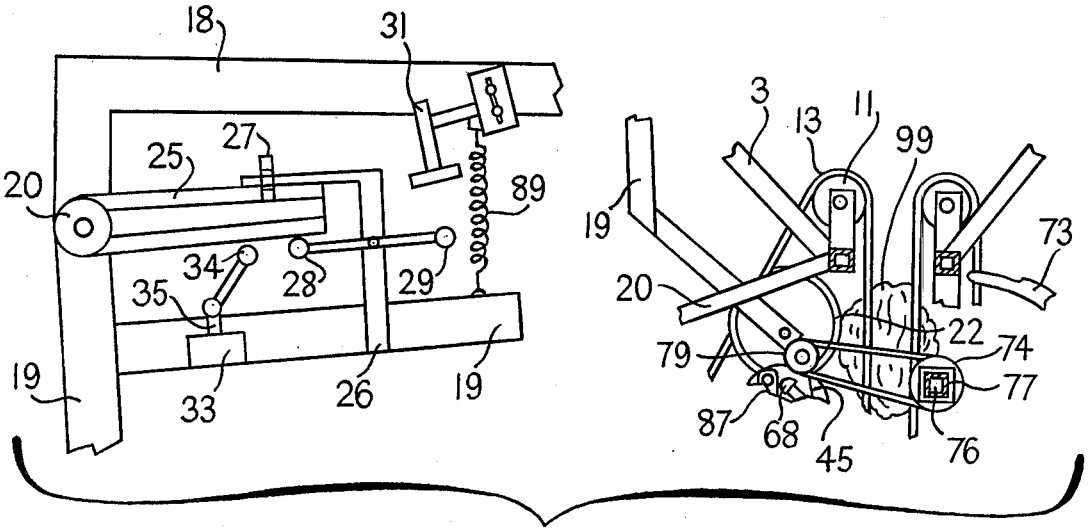
Figure 7:
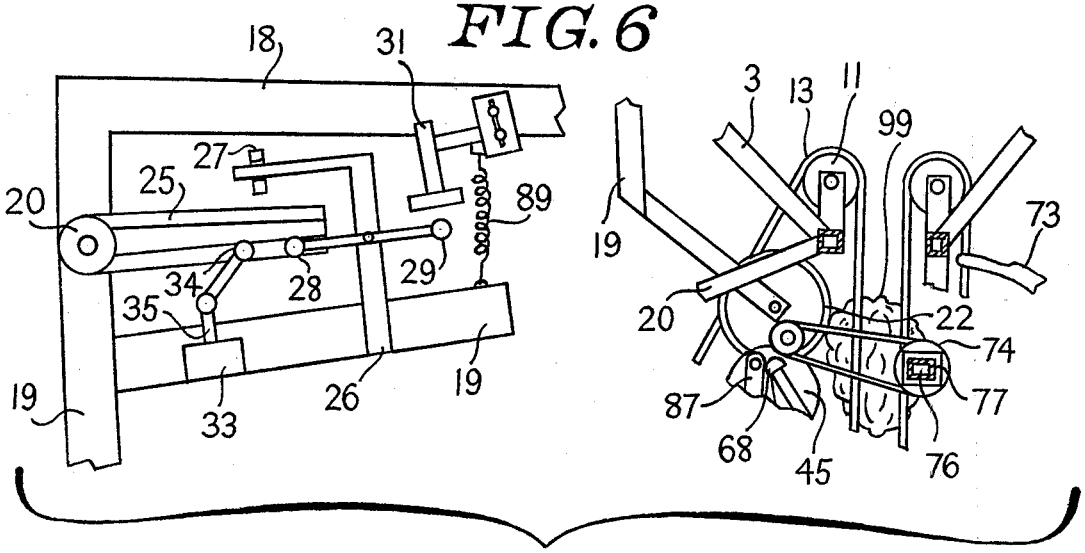
Figure 8:
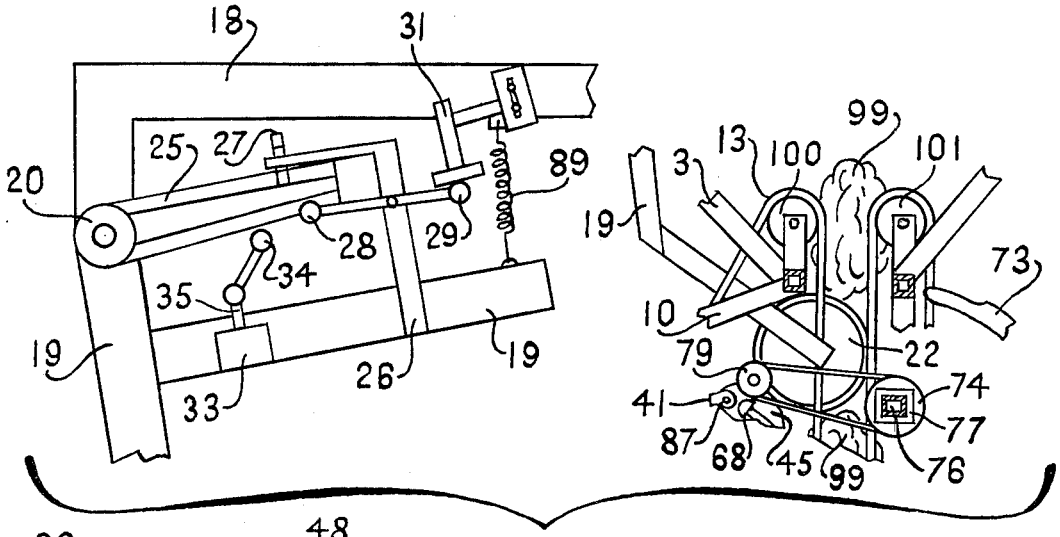

Referring now to FIGS. 1 and 4–8, as the leaves pass through the instant holding means, roller 22 (FIG. 4) on arm 19 which pivots at housing 20 encounters the cauliflower head and moves laterally to roll along the head (FIG. 5). The lateral movement of arm 19 is restricted by spring 89 with a tension of approximately 5 lbs. when measured at roller 22. Generally, the tension at roller 22 must be great enough to reliably follow the plant but not so great such that the plants would be pushed over. The lateral movement of arm 19 is governed by the width of the cauliflower head. In conjunction with this displacement, the upper part of arm 19 moves in a direction away from subframe 18 and set screw 27 comes into contact with brake 25, which also moves in a direction away from subframe 18. However, the sensing means is designed to activate the tying means at a point just after roller 22 passes the center of the vegetable head. To this end, when roller 22 contacts (FIG. 6) and passes the center, or widest part, of the vegetable head (FIG. 7), arm 19 begins to move back into the position from which it started. As arm 19 does so, roller 34 of activator 33 comes into contact with brake 25 and 33 is actuated sending a signal by means of wire 37 to clutch assembly 38 thus activating the tying means. It should be noted at this point that switch 96 is tripped by string 98 which communicates between 55 and 73 and lies across the path of the vegetable head. The head pushes the string against 96 urging 96 rearward. When 96 is tripped a signal is sent to 38 allowing 33 then to activate 38 as described above. In this way the tying means is not actuated unless a plant is sensed. If 22 encounters a rock or other object not having a bulky leaf package, 96 is not tripped because string 98 is not engaged by the leafy package and does not move rearwardly. Thus, even though the sensed object actuates 33, no tying takes place because 96 has not been triggered. This feature of the invention prevents improper functioning of the apparatus caused by extraneous knot formation.

As roller 22 further traverses the leafy package, arm 19 continues to return to its starting position, overcoming the resistance of brake 25, pushing brake 25 in the direction of subframe 18. Roller 29 then contacts stop 31 causing rotation of arm 30 in a clockwise direction. As a result roller 28 pushes brake 25 against set screw 27 and away from switch arm 34 thus deactivating switch 33. The operation of the instant sensing means allows the tying means to be triggered at the same point for each individual head regardless of shape or size. Consequently, all heads are tied and all are tied in the same fashion.

Figure 10:
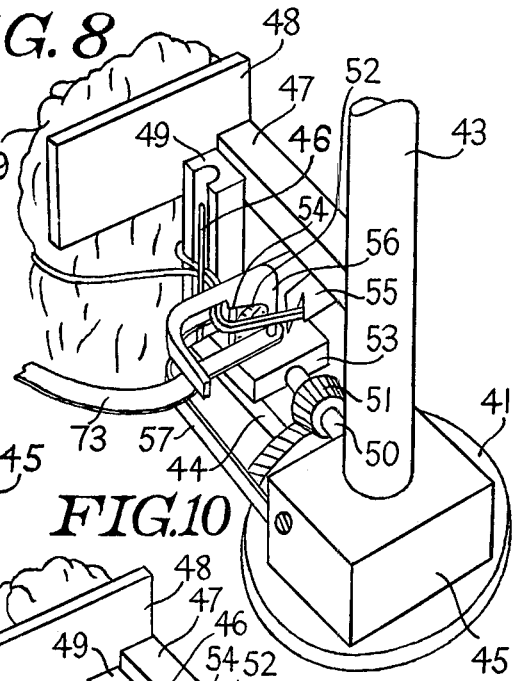
Figure 11:
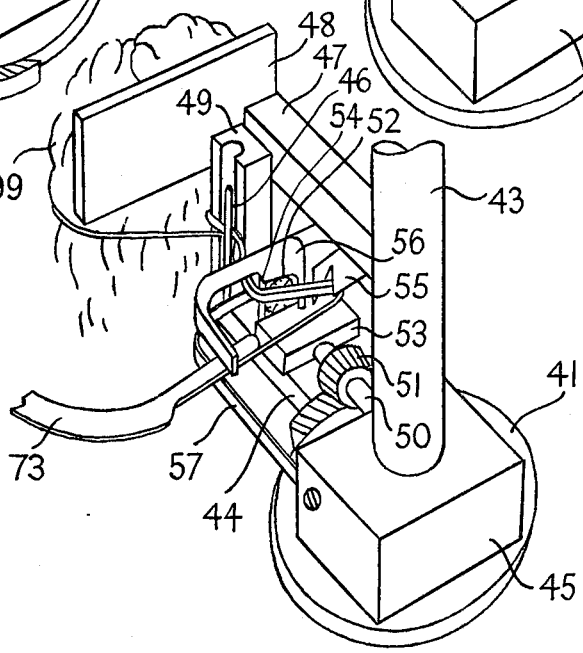

Referring now to FIGS. 9–11, when clutch 38 is activated by switches 96 and 33, gear 40 engages shaft 42 which, being fixedly attached to gear 41, causes 41 to rotate one turn. Simultaneously, needle 73 driven by crank 88 through arms 69 rotates in toward stripper 57. The needle passes through stripper 57 and into string holder 55. Flipper 46 actuated by gear 41 positions the string against tying bills 52. Needle 72 withdraws from stripper 57 and bills 52 tie a conventional knot. Flipper 46 firmly pushes the string against anvil 49 and stripper 57 moves upwardly thus removing the knot from bills 52 as the string is cut by knife 56. It is important in this particular operation that the string be held firmly to allow the removal of the knot from the bills and the cooperation between 46 and 49 attains this end.

During the sensing and knotting operations parallel linkages 61 and 62 maintain the tying means stationary with respect to the plant being tied. This is accomplished as follows. Shaft 42 also drives crank arm 88, which simultaneously drives linkage arms 87 and 64 and needle 73. As linkage arm 87 is moved in a rearward direction, linkage arm 67 follows forcing the tier frame back on parallel linkage arms 61 and 62. This motion is timed to maintain the tier stationary relatively to the plant being tied and to move the tier forward again after the plant has been tied.

As roller 22 engages another plant, the reset sensing means performs as described above and the tying operation is repeated.

It is within the compass of the invention to include a reset timing device communicable with clutch assembly 38 by means of switch 96. In this particular embodiment of the invention the clutch is actuated a certain period of time after the string is urged rearward by a plant or other object tripping switch 96. This feature of the instant apparatus assures operation of the tying means whether or not a plant is sensed by roller 22.

The apparatus of the invention can be attached to a tractor or other vehicle by conventional means to provide motorization. Furthermore, the essential features of the apparatus may be incorporated into a device which is self-contained, i.e., contains its own sources for power and mobility. Other embodiments of the apparatus of the invention will be suggested to those skilled in the art. It is also within the compass of the invention to use several of the apparatus of the invention in a multi-unit system for tying the plants in several rows at one time.

Having thus described our invention we claim:

1. An apparatus for tying loosely-defined, soft packages, which comprises:

(a) a frame, (b) means attached to said frame for gathering the loosely-defined, soft packages, (c) means for holding the gathered packages attached to said frame and communicating with said gathering means, (d) means for tying the gathered and held packages attached to said frame, and (e) means attached to said frame for actuating said tying means at the same relative position for each package tied.

2. The apparatus of claim 1 wherein said tying means includes:

(a) a frame, (b) a pair of parallel linkages mounted on said frame, (c) a needle rotatably mounted on said frame and communicating with said actuating means for conveying string around the gathered package, (d) an anvil mounted on said frame, (e) a cam-operated flipper mounted on said frame and communicating with said actuating means to position the string against said anvil, (f) means for knotting the so-positioned string mounted on said frame, and (g) means for removing the knot from said knotting means.

3. The apparatus of claim 1 wherein the means for actuating said tying means includes means for sensing the gathered package.

4. The apparatus of claim 3 wherein the means for sensing the gathered package includes a spring-loaded, horizontally positioned roller which travels along the gathered package below the holding means and actuates the tying means at a point whereat said roller just passes the center of the gathered package.

5. The apparatus of claim 3 wherein the means for sensing the gathered package includes means for actuating said tying means only when a package is gathered in said gathering means.

6. The apparatus of claim 5 wherein said means for actuating said tying means only when a package is gathered includes a pair of cooperating switches communicable with said tying means.

* * * * *